US008777591B2

(12) United States Patent
Cho et al.

(10) Patent No.: US 8,777,591 B2
(45) Date of Patent: Jul. 15, 2014

(54) ELECTRICALLY DRIVEN COMPRESSOR SYSTEM FOR VEHICLES

(75) Inventors: Huan-Kuei Cho, Lujhu Township (TW); Ming-Feng Chou, Lujhu Township (TW)

(73) Assignee: Heng Sheng Precision Tech. Co., Ltd., Lujhu Township (TW)

( * ) Notice: Subject to any disclaimer, the term of this patent is extended or adjusted under 35 U.S.C. 154(b) by 91 days.

(21) Appl. No.: 13/543,273

(22) Filed: Jul. 6, 2012

(65) Prior Publication Data

US 2012/0275939 A1 Nov. 1, 2012

Related U.S. Application Data

(63) Continuation-in-part of application No. 12/706,136, filed on Feb. 16, 2010, now abandoned.

(51) Int. Cl.

| | |
|---|---|
| ***F04B 39/06*** | (2006.01) |
| ***F04B 35/04*** | (2006.01) |
| ***F04C 18/02*** | (2006.01) |
| ***F04D 25/08*** | (2006.01) |

(52) U.S. Cl.

CPC ..... *F04C 18/0215* (2013.01); *F04D 25/082* (2013.01)

USPC ..... 417/366; 417/410.5; 417/410.1

(58) Field of Classification Search

CPC ..... F04C 18/0215; F04D 29/5813; F04D 29/5806; F04D 25/082

USPC ..... 417/410.1, 410.5, 366

See application file for complete search history.

(56) References Cited

U.S. PATENT DOCUMENTS

| | | | | |
|---|---|---|---|---|
| 5,215,451 | A * | 6/1993 | Hara et al. | 418/55.1 |
| 5,320,506 | A * | 6/1994 | Fogt | 418/55.3 |
| 5,382,144 | A * | 1/1995 | Tanaka et al. | 418/55.3 |
| 6,501,662 | B2 * | 12/2002 | Ikeda | 361/760 |
| 6,511,295 | B2 * | 1/2003 | Suitou et al. | 417/44.1 |
| 6,619,933 | B2 * | 9/2003 | Ikeda | 417/410.1 |
| 7,009,318 | B2 * | 3/2006 | Iritani et al. | 310/58 |
| 7,122,928 | B2 * | 10/2006 | Shindo | 310/89 |
| 7,179,068 | B2 * | 2/2007 | Makino et al. | 418/55.4 |
| 7,207,187 | B2 * | 4/2007 | Funahashi et al. | 62/228.4 |
| 7,473,080 | B2 * | 1/2009 | Kawada et al. | 417/423.14 |
| 2001/0014029 | A1 * | 8/2001 | Suzuki et al. | 363/141 |
| 2002/0025265 | A1 * | 2/2002 | Ikeda | 417/410.1 |
| 2002/0062656 | A1 * | 5/2002 | Suitou et al. | 62/259.2 |
| 2003/0002998 | A1 * | 1/2003 | Makino et al. | 417/374 |
| 2003/0143090 | A1 * | 7/2003 | Iritani et al. | 417/410.5 |
| 2004/0013543 | A1 * | 1/2004 | Kimura et al. | 417/410.5 |
| 2004/0013544 | A1 * | 1/2004 | Kimura et al. | 417/410.5 |
| 2004/0052660 | A1 * | 3/2004 | Kimura et al. | 417/410.3 |

(Continued)

*Primary Examiner* — Charles Freay
*Assistant Examiner* — Alexander Comley
(74) *Attorney, Agent, or Firm* — Wang Law Firm, Inc.; Li K. Wang; Stephen Hsu

(57) ABSTRACT

An electrically driven compressor system for vehicles has a hollow shell, inside which there is a transmission set and a scroll set. The outer surrounding of the hollow shell is formed with a chamber. A control circuit board is disposed in the chamber. A processing chip is provided on the side of the control circuit board that faces the bottom of the chamber. A thermal paste is coated on the end surface of the processing chip towards the bottom of the chamber. The end surface of the processing chip with the thermal paste coating urges against the bottom surface of the chamber.

6 Claims, 3 Drawing Sheets

(56) References Cited

U.S. PATENT DOCUMENTS

| | | | | |
|---|---|---|---|---|
| 2004/0197213 | A1* | 10/2004 | Takemoto | 417/410.1 |
| 2005/0011213 | A1* | 1/2005 | Shindo et al. | 62/259.2 |
| 2005/0063836 | A1* | 3/2005 | Kimura et al. | 417/313 |
| 2005/0196285 | A1* | 9/2005 | Jayanth | 417/44.11 |
| 2007/0231165 | A1* | 10/2007 | Koide et al. | 417/410.1 |
| 2008/0181791 | A1* | 7/2008 | Iguchi et al. | 417/45 |
| 2009/0010786 | A1* | 1/2009 | Koide et al. | 417/423.14 |
| 2009/0151389 | A1* | 6/2009 | Iguchi et al. | 62/505 |
| 2009/0162222 | A1* | 6/2009 | Iguchi et al. | 417/410.1 |
| 2009/0269222 | A1* | 10/2009 | Fukasaku et al. | 417/410.1 |
| 2010/0018243 | A1* | 1/2010 | Tanaka et al. | 62/508 |
| 2010/0086413 | A1* | 4/2010 | Matsukawa et al. | 417/18 |
| 2010/0170294 | A1* | 7/2010 | Nakagami et al. | 62/505 |
| 2010/0172770 | A1* | 7/2010 | Ichise et al. | 417/366 |

* cited by examiner

ELECTRICALLY DRIVEN COMPRESSOR SYSTEM FOR VEHICLES

CROSS-REFERENCE TO RELATED APPLICATION

This application is a Continuation-In-Part application of Ser. No. 12/706,136, filed Feb. 16, 2010, and entitled "POWER DRIVEN COMPRESSOR SYSTEM FOR VEHICLES", now pending.

BACKGROUND OF THE INVENTION

1. Field of Invention

The invention relates to a compressor and, in particular, to an electrically driven compressor system for vehicles.

2. Related Art

In general, the compressor system for vehicles is usually driven by the gasoline engine. However, recently due to the soaring oil price and other limited resources will eventually run out, all car makers have committed to the research and development of electrically driven vehicles. It is also an inevitable trend to change the vehicle compressor system into fully electrically powered.

Nevertheless, currently the electrically driven compressor system (such as refrigerators and other appliances) cannot be directly transferred to vehicles because of the following reasons:

The compressor system for home appliances has a chamber at its the bottom for holding refrigerant oil. As the compressor operates, the refrigerant oil is simultaneously sucked up to lubricate internal components of the compressor. Therefore, the compressor system of home appliances must be kept in a still environment in order to avoid the situation where the refrigerant oil cannot be sucked up, resulting in damages to the compressor due to insufficient lubrication. However, there must be vibrations in a running or operating vehicle, compressor systems for household appliances cannot be applicable to vehicles.

Furthermore, the environmental temperature caused by the vehicle in operation is higher. It is likely to cause the compressor motor to overheat and result in performance degradation. The high environmental temperature will also cause circuit damages to the compressor system.

SUMMARY OF THE INVENTION

An objective of the invention is to provide an electrically driven compressor system for vehicles, which is driven fully by electrical power to provide a better cooling effect inside the compressor during its operation.

To achieve the above objective, the disclosed electrically driven compressor system for vehicles includes: a hollow shell, a control circuit board, a transmission set, and a scroll set.

The hollow shell consists of a bottom cover and an end cap. The circumference of the bottom cover is formed with a chamber. The chamber has a bottom surface, which is formed with a column at the four corners. The side of the bottom cover near the chamber has an intake connecting to the interior of the bottom cover. The end of the bottom cover connecting to the end cover has a plurality of through holes in communications with the interior of the bottom cover. The end cap has an outlet connecting to the interior thereof.

The control circuit board is disposed in the chamber. The control circuit board has a positioning hole for each of the columns. The control circuit board is then connected with the columns via the positioning holes. The side of the control circuit board facing the bottom surface of the chamber has a processing chip. The end surface of the processing chip facing the bottom surface of the chamber is coated with a thermal paste. The thermal paste coated end surface of the processing chip urges against the bottom surface of the chamber.

The transmission set is disposed in the bottom cover and electrically connected with the control circuit board. The transmission set has a transmission axle, a rotor connected to the transmission axle, and a stator around the rotor. The transmission set is driven by the electrical power of the control circuit board to generate a rotating magnetic field. Therefore, the rotor drives the transmission axle to rotate.

The scroll set is disposed in the end cap. The scroll set is composed of a static scroll and a dynamic scroll. The dynamic scroll is connected to the transmission axle and driven by the transmission axle to rotate around the static scroll in an eccentric way, thereby producing a compressing effect. An Oldham ring is interposed between the dynamic scroll and the bottom cover. The circumference of the Oldham ring has a cross-shaped limiting part. A concave part for accommodating the limiting part is formed on the bottom cover and the dynamic scroll.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
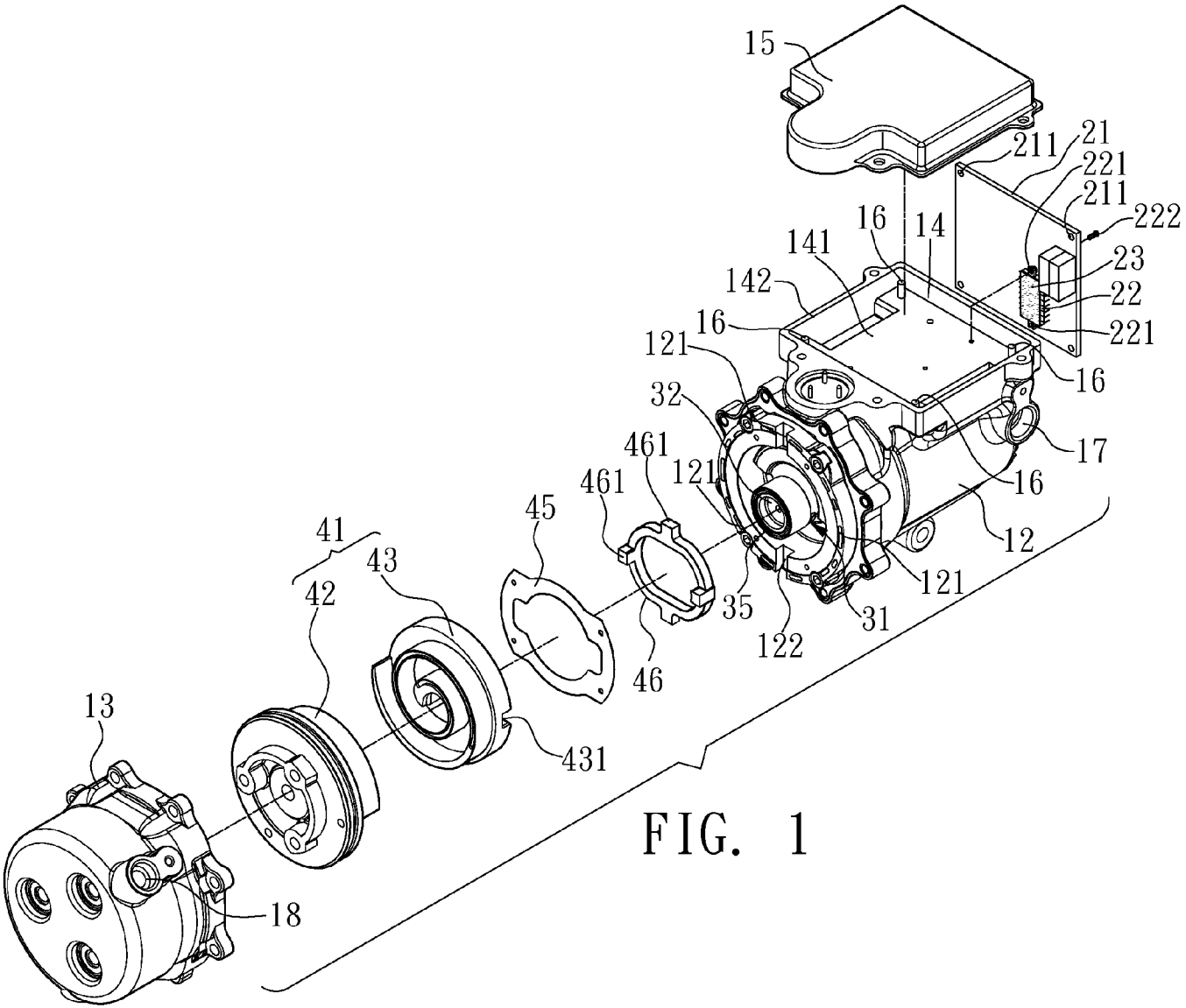
FIG. 1 is a three-dimensional exploded view of the invention.
Figure 2:
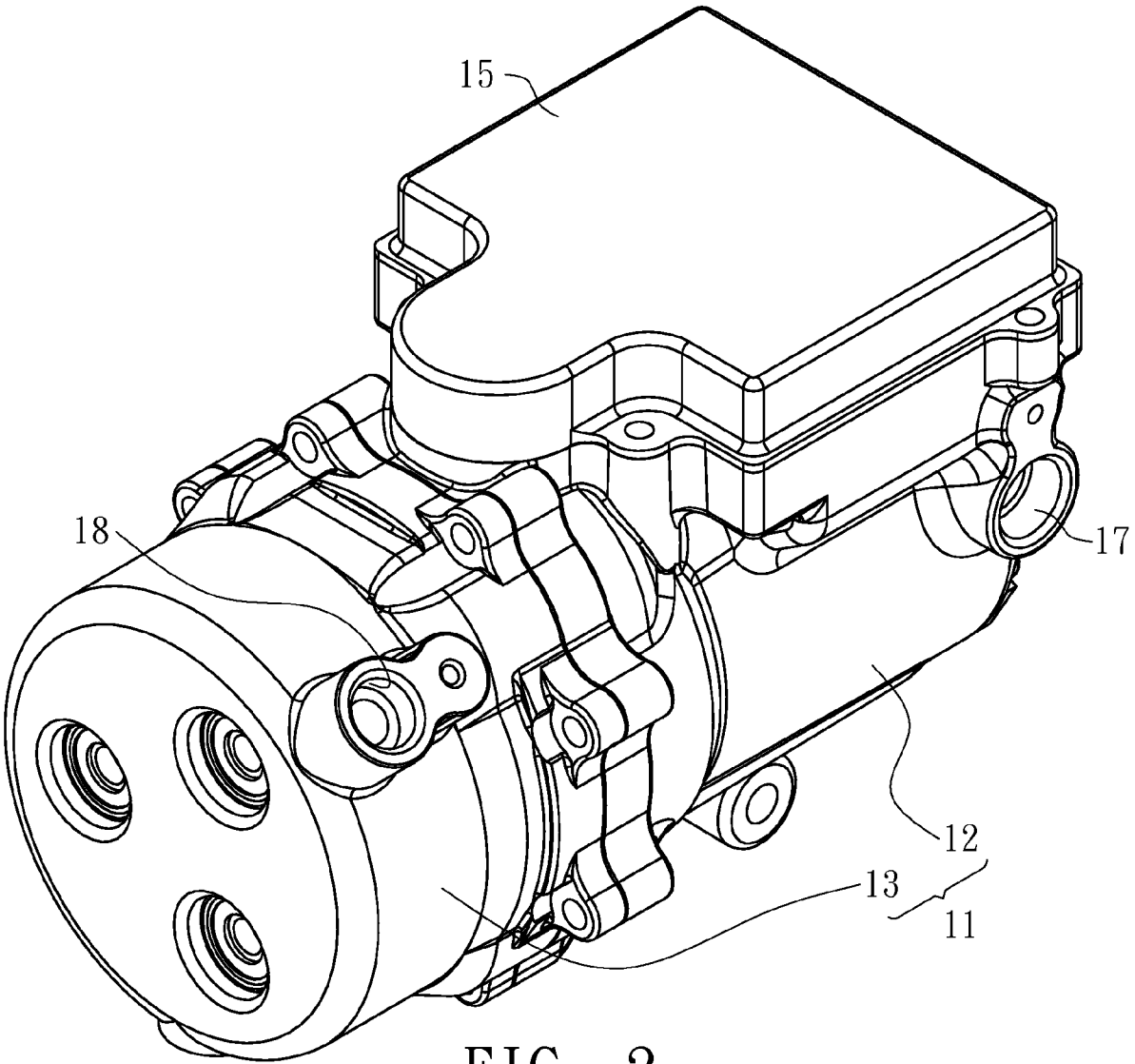
FIG. 2 is a three-dimensional view of the invention after assembly.
Figure 3:
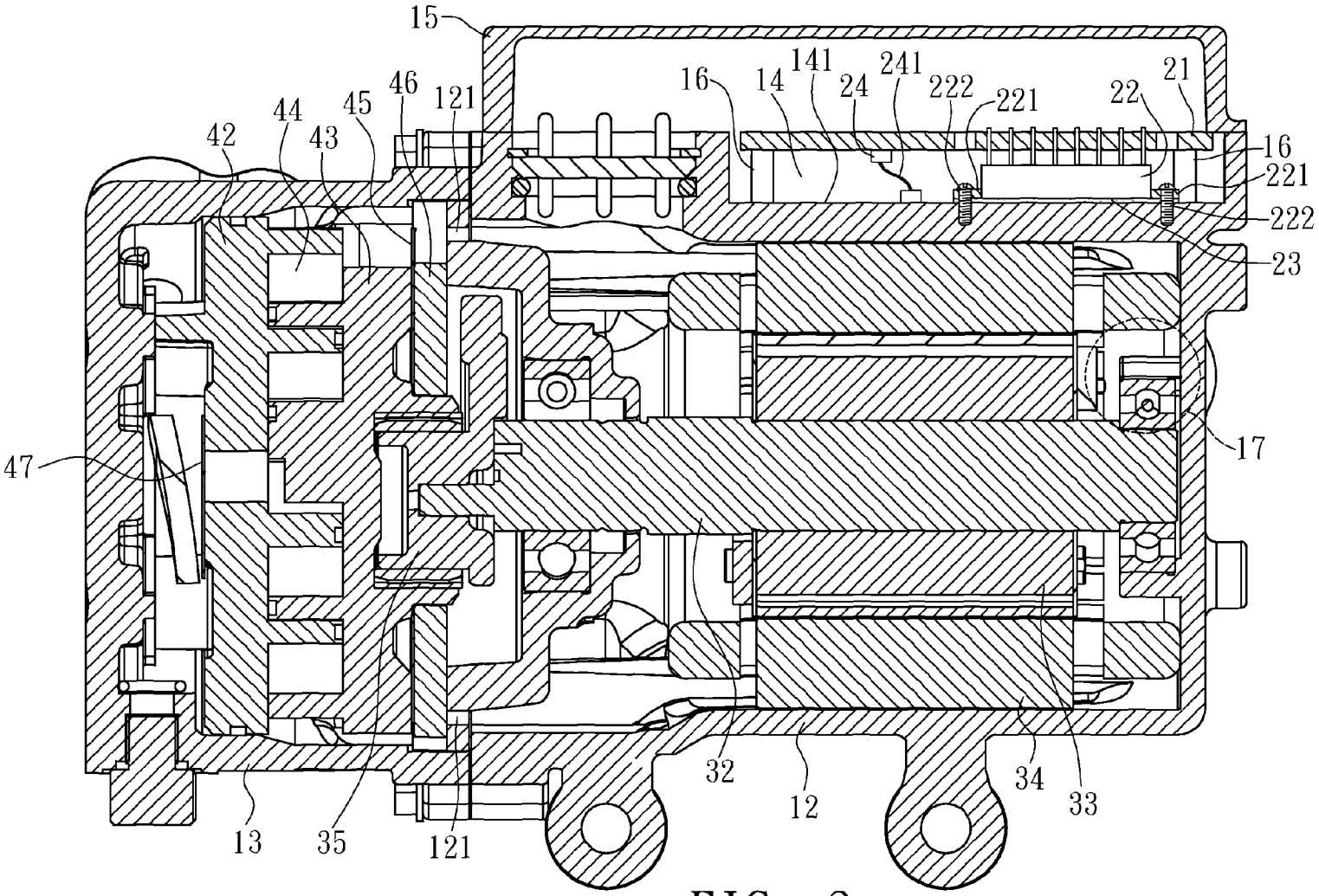
FIG. 3 is a cross-sectional view of the invention.

Please refer to FIGS. 1 to 3. The disclosed electrically driven compressor system for vehicles mainly includes a hollow shell 11, a control circuit board 21, a transmission set 31, and a scroll set 41.

The hollow shell 11 consists of a bottom cover 12 and an end cap 13. The circumference of the bottom cover 12 is formed with a chamber 14. The chamber 14 has a bottom surface 141 and an upward opening 142. A side plate 15 can correspondingly cover the opening 142 of the chamber 14 to close the connection between the chamber 14 and the external space. The four corners of the bottom surface 141 of the chamber 14 are formed respectively with a column 16. The side of the bottom cover 12 near the chamber 14 has an intake 17 connecting to the interior of the bottom cover 12. The end of the bottom cover 12 toward the end cap 13 has a plurality of through holes in communications with the interior of the bottom cover 12 and two was the concave parts 122 that are opposite to each other. The end cap 13 is formed with an outlet 18 connecting to the interior thereof.

The control circuit board 21 is disposed in the chamber 14. The control circuit board 21 has a positioning hole 211 corresponding to each of the columns 16. The control circuit board 21 is connected with the columns 16 via the positioning holes 211. The side of the control circuit board 21 toward the bottom surface 141 of the chamber 14 has a processing chip 22. The processing chip 22 is an insulated gate bipolar transistor (IGBT). The end surface of the processing chip 22 toward the bottom surface 141 of the chamber 14 is coated with a thermal paste 23. The thermal paste coated end surface of the processing chip 22 urges against the bottom surface 141 of the chamber 14. The two opposite sides of the processing chip 22 are protruded respectively with a positioning part 221 urging against the bottom surface 141 of the chamber 14. Each of the two positioning parts 221 corresponds to a positioning element 222, so that the processing chip 22 is firmly positioned on the bottom surface 141 of the chamber 14.

The transmission set 31 is disposed in the bottom cover 12 and electrically connected with the control circuit board 21. The transmission set includes a transmission axle 32, a rotor 33 connected to the transmission axle 32, and a stator 34 around the rotor 33. The coil of the transmission set 31 is made of an acid/alkali resistant enameled wire. The stator 34 is fixed to the inner wall of the bottom cover 12. The driving end of the transmission axle 32 is provided with a bearing 35 in an eccentric way. The transmission set 31 is driven by the electrical power controlled by the control circuit board 21 to generate a rotating magnetic field. The rotor 33 drives the transmission axle 22 to rotate.

As shown in FIG. 3, in this embodiment, the control circuit board 21 has a temperature sensing unit 24. The temperature sensing unit 24 and the processing chip 22 are electrically connected to interact with each other. The temperature sensing unit 24 is connected via a wire 241 to the bottom surface 141 of the chamber 14, thereby sensing the temperature on the bottom surface 141 of the chamber 14. The temperature sensing unit 24 is set with a preset temperature. When the temperature unit 24 detects that the temperature on the bottom surface 141 of the chamber 14 is higher than the preset temperature, a stop signal is transmitted to the processing chip 22 to stop the operation of the transmission set 31.

The scroll set 41 is disposed in the end cap 13. The scroll set 41 has a static scroll 42 and a dynamic scroll 43. The two scroll sets 42, 43 have spiral inner walls that match with each other, thereby forming a compression space 44 in between. The bottom end of the dynamic scroll 43 is connected to the bearing 35 on the driving end of the transmission axle 32, thereby driving the dynamic scroll 43 to rotate with respect to the static scroll 42 in an eccentric way. As the dynamic scroll 43 rotates around the static scroll 42, the volume of the compression space 44 changes to achieve the effect of compressing the working fluid. The bottom end of the dynamic scroll 43 has two opposite concave parts 431. A limiting plate 45 and an Oldham ring 46 are interposed between the dynamic scroll 43 and the bottom cover 12. The circumference of the Oldham ring 46 has a cross-shaped limiting part 461 corresponding to the dynamic scroll 43 and the concave parts 431, 122 of the bottom cover 12. The concave parts 431, 122 restrict the moving direction of the limiting part 461 of the Oldham ring 46. This in turn restricts the dynamic scroll 43 to have an eccentric rotation radius within a default value.

In practice, the invention uses the electrical power controlled by the control circuit board 21 to drive the transmission set 31. When the transmission set 31 operates, a working fluid as a mixture of low-pressure coolant and refrigerant oil enters via the intake 17 of the bottom cover 12 and fills the bottom cover 12. The transmission set 31 inside the bottom cover 12 gets effective cooling and lubrication. Since the intake 17 is on the side of the bottom cover 12 near the chamber 14, when the low-temperature working fluid enters it directly cools the bottom surface 141 of the chamber 14. This facilitates heat dissipation of the processing chip 22 in contact with the bottom surface 141 of the chamber 14.

Through the eccentric rotation of the dynamic scroll 43, the working fluid in the bottom cover 12 is sucked into the end cap 13 via the through holes 121 and into the compression space 44 between the dynamic scroll 43 and the static scroll 42 for compression. The compressed high-pressure working fluid then passes through a valve 47 comprised of a reed and discharges through the outlet 18 of the end cap 13 for external uses. Of course, the working fluid sucked by the scroll set 41 also has cooling and lubricating effects on the components inside the end cap 13.

According to the above description, the invention has the following advantages:

1. The invention uses a working fluid which is a mixture of low-pressure coolant and refrigerant oil. Therefore, the disclosed compressor system is applicable to vehicles and non-static environments. When electrical power drives the transmission set 31, the working fluid enters via the intake 17 of the bottom cover 12 into the compressor. The components inside the compressor are thus cooled and lubricated, effectively reducing the wearing of the compressor during the operation of its motor.

2. The intake 17 is formed on the side of the bottom cover 12 near the chamber 14. When the low-temperature working fluid enters via the intake 17, it directly cools the bottom surface 141 of the chamber 14, effectively dissipating the heat produced by the processing chip 22 in contact with the bottom surface 141 of the chamber 14.

3. The end surface of the processing chip 22 in connection the bottom surface 141 of the chamber 14 is coated with a thermal paste 23. The tiny roughness on the processing chip 22 is filled with the thermal paste 23. The positioning elements 222 lock the positioning parts 221 on both sides of the processing chip 22, so that the processing chip 22 and the bottom surface 141 of the chamber 14 are more tightly connected to enhance heat dissipation.

4. The control circuit board 21 is connected to the columns in the chamber 14 via the positioning holes 211. In addition to achieving the goal of rapid assembly, the invention can effectively buffer the vibrations during the operation of the transmission set.

5. The control circuit board 21 further has a temperature sensing unit 24. When the temperature sensing unit 24 detects that the temperature on the bottom surface 141 of the chamber 14 is higher than a preset temperature, the transmission set 31 is automatically stopped to ensure the safety of the invention.

6. An Oldham ring 46 is inserted between the dynamic scroll 43 and the bottom cover 12. The cross-shaped limiting part 461 on the Oldham ring 46 corresponds to the bottom cover 12 and the concave parts 122, 431 on the dynamic scroll 43. The concave parts 122, 431 restrict the moving direction of the limiting part 461 of the Oldham ring 46. This ensures that the eccentric rotation radius of the dynamic scroll 43 is within a default value range.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. An electrically driven compressor system for vehicles, comprising:

a hollow shell consisting of a bottom cover and an end cap, wherein a circumference of the bottom cover is formed with a chamber having a bottom surface; four corners of the bottom surface of the chamber are each formed with a column, respectively; a side of the bottom cover near the chamber is formed with an intake in connection with an interior of the bottom cover; an end of the bottom cover facing the end cap is annually formed with a plurality of through holes in communication with the interior of the bottom cover; and the end cap has an outlet in communication with an interior thereof;

a control circuit board disposed in the chamber and having a positioning hole for each of the columns, wherein the control circuit board is connected with the columns via the positioning holes; a processing chip with two opposite sides is provided on a side of the control circuit board facing the bottom surface of the chamber; an end surface of the processing chip facing the bottom surface of the chamber is coated with a thermal paste; and the end surface of the processing chip urges against the bottom surface of the chamber;

a transmission set disposed in the bottom cover and electrically connected with the control circuit board; wherein the transmission set includes a transmission axle, a rotor connected to the transmission axle, and a stator around the rotor; the transmission set is driven by electrical power from the control circuit board to generate a rotating magnetic field; and the rotor drives the transmission axle to rotate; and a scroll set disposed in the end cap and consisting of a static scroll and a dynamic scroll, wherein the dynamic scroll is connected with the transmission axle and driven by the transmission axle to rotate with respect to the static scroll in an eccentric way, thereby producing a compression effect; an Oldham ring is interposed between the dynamic scroll and the bottom cover, a circumference of the Oldham ring has a cross-shaped limiting part; and concave parts for accommodating the limiting part are formed on the bottom cover and the dynamic scroll, respectively;

wherein the control circuit board has a temperature sensing unit connected to the bottom surface of the chamber via a conducting wire for detecting a temperature on the bottom surface of the chamber, the temperature sensing unit is set with a preset temperature, wherein when the temperature sensing unit detects that the temperature on the bottom surface of the chamber is higher than the preset temperature a stop signal is transmitted to the processing chip to stop the operation of the transmission set.

2. The electrically driven compressor system for vehicles of claim 1, wherein the chamber of the bottom cover has an upward opening and a side plate correspondingly covers the opening of the chamber to close a connection between the chamber and an external space.

3. The electrically driven compressor system for vehicles of claim 1, wherein each of the two opposite sides of the processing chip are protruded with a positioning part urging against the bottom surface of the chamber, and each of the positioning parts holds a positioning element, thereby positioning the processing chip on the bottom surface of the chamber.

4. The electrically driven compressor system for vehicles of claim 1, wherein the stator is fixed to an inner wall of the bottom cover, a bearing is provided eccentrically on the transmission axle, and the dynamic scroll is connected to the bearing on the transmission axle.

5. The electrically driven compressor system for vehicles of claim 1, wherein the transmission set sends a working fluid consisting of a mixture of low-pressure coolant and refrigerant oil via the intake into the bottom cover.

6. The electrically driven compressor system for vehicles of claim 1, wherein the end of the bottom cover facing the end cap has two opposite concave parts, a bottom end of the dynamic scroll has another two opposite concave parts, the cross-shaped limiting part of the Oldham ring is correspondingly accommodated in the concave parts, and the concave parts restricts the moving direction of the limiting part of the Oldham ring, thereby ensuring that the eccentric rotation radius of the dynamic scroll within a default value range.

* * * * *